United States Patent [19]

Colby et al.

[11] 4,166,952

[45] Sep. 4, 1979

[54] METHOD AND APPARATUS FOR THE ELEMENTAL ANALYSIS OF SOLIDS

[75] Inventors: Bruce N. Colby, Carlsbad; Charles W. Hull, Sierra Madre, both of Calif.

[73] Assignee: E. I. Du Pont de Nemours and Company, Wilmington, Del.

[21] Appl. No.: 880,946

[22] Filed: Feb. 24, 1978

[51] Int. Cl.[2] ..... B01D 59/44

[52] U.S. Cl. ..... 250/288; 250/309; 250/427

[58] Field of Search ..... 250/288, 427, 309

[56] References Cited

U.S. PATENT DOCUMENTS

| | | | |
|---|---|---|---|
| 3,155,826 | 11/1964 | Peters | 250/427 |
| 3,461,285 | 8/1969 | Werner | 250/427 |
| 3,660,655 | 5/1972 | Wardell | 250/427 |

*Primary Examiner*—Harold A. Dixon

[57] ABSTRACT

A method has been devised whereby material is removed from a solid surface and ionized to produce singly charged monatomic ions representative of the surface. A sample of the material (or surface) is mounted in place of the repeller electrode of an ion source, biased negatively with respect to the source's block and sputtered with argon ions. Some of the sputtered sample material is ionized by charge exchange with the argon ions near the ion source's exit slit and accelerated into a mass analyzer. An electron beam is used to ionize the argon sputtering gas. This method provides an advantage in that the initial kinetic energy spread of the monatomic ions is much lower than with other methods.

To perform this method, the solid sample is mounted upon a removable probe which is introduced into the ion source or ion chamber of a mass spectrometer. More specifically, the sample is placed in a recessed cavity in the end of the probe located opposite the exit slit of the ion chamber. In this manner, the non-conductive walls of the probe aid in directing the argon ions perpendicularly onto the surface of the solid sample, thereby increasing the yield of ions which pass through the exit slit.

10 Claims, 3 Drawing Figures

METHOD AND APPARATUS FOR THE ELEMENTAL ANALYSIS OF SOLIDS

TECHNICAL FIELD

This invention relates to a method and apparatus for the elemental analysis of solids by mass spectrometry and, more particularly, to a method and apparatus for improving the yield of elemental particles to be analyzed.

BACKGROUND ART

There are a number of known ion sources for the elemental analysis of solids by mass spectrometry. Among these are "plain discharge sputtering" such as described in an article by Colburn et al., entitled "A new technique for elemental analysis of thin surface layers of solids", Applied Physics Letters, Vol. 19, No. 9, pg. 350, Nov. 1, 1971. According to Colburn et al., a sample is immersed in an RF sputtering glow discharge and a fraction of those sputtered atoms, which are ionized in the Penning discharge, are monitored with a quadrapole mass filter. In a letter appearing in Analytical Chemistry, Vol. 46, No. 3, March, 1974, beginning on page 461, Harrison et al. describe a modification of the Colburn et al. technique in which a hollow cathode tube is used as the ion source. In both of these techniques a self sustaining electrical discharge is used for the generation of ions. While this is adequate for most purposes, unfortunately the initial kinetic energy spread of the resulting ion beam is relatively high. Because of this the elemental ions must be analyzed with mass spectrometers capable of accepting a relatively high degree of energy spread. This necessity implies more expensive complex instruments than would be required with an ion beam having narrow energy spread.

Another problem encountered with some of these prior techniques is that the useable sputtering pressures are relatively limited since the hollow cathode has a rather limited pressure vs. discharge characteristic. This limits the versatility of the technique rather severely. Another problem encountered in these prior systems is that the sputtering rate is not easily controlled. This can limit the size of the sample, particularly if the surface being analyzed is a relatively thin one.

Accordingly, it is an object of this invention to provide an improved method for the elemental analysis of solids.

Another object of this invention is to provide an improved apparatus that facilitates the elemental analysis of solids.

DISCLOSURE OF INVENTION

In a preferred method of the invention, the elemental analysis of solids may be accomplished using a mass spectrometer having a mass analyzer, an ion chamber with a repeller electrode and an exit slit for passing ions into the mass analyzer. The analysis includes the steps of introducing an ionizing gas into the ion chamber to provide a sputtering gas, ionizing the ionizing gas in the chamber with the electron beam, reducing the electrical potential of the repeller electrode to a value less than that of the exit slit, positioning the solid material sample, whose surface is to be analyzed, on the repeller electrode, whereby the surface is sputtered to provide neutral elemental particles, and directing the elemental particles toward the exit slit to become ionized by charge exchange with the ionizing gas and to pass through the exit slit into the mass analyzer.

Preferably, the ionizing gas is directed perpendicularly toward the surface of the sample by an electrically non-conductive shield. This shield may be coaxially positioned about the sample, and preferably is positioned such that the sample surface under analysis is substantially parallel to the plane of the exit slit. In this manner an increased population of neutral elemental particles is directed toward the exit slit which increases the yield of available ions.

An apparatus for effecting the elemental analysis of particles is used in a mass spectrometer having an ion source which includes a vacuum chamber, an inlet to the chamber for introducing an ionizing gas into the chamber, electron beam means for ionizing the gas, electrically energized electrode means including a repeller electrode and an exit slit for withdrawing ions from the chamber through the slit to form an ion beam, a mass analyzer section for deflecting ions from the exit slit according to their mass, and detecting means for detecting those ions within the ion beam which have been deflected by a given angle by the mass analyzer section.

According to one aspect of this invention, a conventional ion source is modified by including means for introducing an ionizing gas into the chamber, means to evacuate the chamber to an ion sputtering pressure in the presence of the ionizing gas, means to apply a potential to the repeller electrode that is negative with respect to that of the slit, a probe that may be removably introduced into the chamber, means for mounting the repeller electrode on the probe so that ions of the ionizing gas impinge on the repeller electrode for sputtering particles from its surface into the interior of the chamber, whereby some of the particles which are neutral in charge and in the vicinity of said slit become ionized by charge exchange with the ionizing gas and pass through the exit slit.

In one embodiment of the apparatus, the probe is elongated and has a longitudinal axis, the repeller electrode being positioned coaxially within one end of the probe that is introduced into the chamber, thereby to direct sputtered material toward the exit slit. Desirably, the probe end is formed of an electrically nonconductive material as this aids in concentrating the ions directly onto substantially all of the surface in a direction normal to the surface. Conversely the neutral elemental particles leave the surface mostly in a direction perpendicular to the surface such that they are directed to the vicinity of the exit slit where, if they become ionized by the ionizing gas, they are able to pass through the slit. This increases the yield of ions which can pass through the exit slit.

This method and apparatus have the advantage that the initial kinetic energy spread of the ions from the solid sample is quite low so that the mass analyzer does not have to be of the energy focusing type. This greatly reduces the complexity of the mass spectrometer. Furthermore, this analysis permits surface analysis of elemental solid samples, since the sample material is only removed from the surface. As the original surface is removed, lower layers are exposed and in-depth profiles are generated. Further bulk analysis can be achieved by integrating spectral intensities over an extended period of time so that the data obtained represents a significant volume of the sample.

Figure 1:
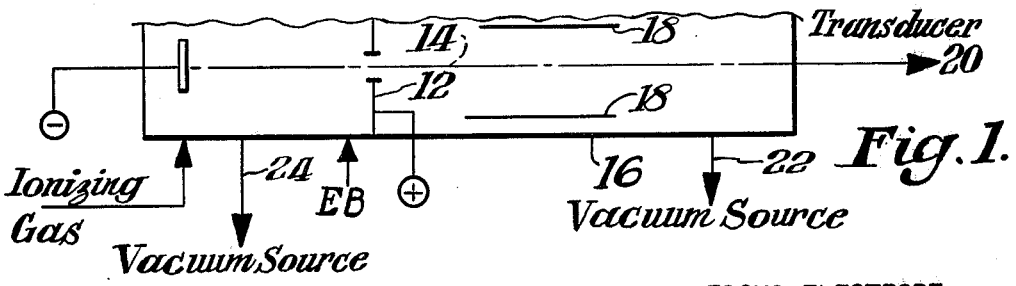
FIG. 1 illustrates a mass spectrometer in block diagram.

Best Mode for Carrying Out the Invention

According to the method of this invention, an ionizable gas, preferably an inert gas mixture normally present in the ion source itself, is introduced into the region between the exit slit and an electrode, preferably the repeller electrode, opposite the exit slit, of a conventional ion source to which the ion repelling and extracting electrical potentials are normally applied. The ionizing gas is bombarded by an electron beam which permits precise control of the energy spread of the resulting ions. The repeller electrode is adjusted in potential such that its potential is negative with respect to that of the exit slit and the remainder of the chamber. A solid sample, which it is desired to surface analyze, is positioned on or forms the repeller electrode. The gas ions thus formed, subjected to the thus modified electric fields within the source, are caused to strike the repeller electrode, in this case, made of the sample whose surface is to be analyzed, causing elemental particles of the sample to be ejected (sputtered) therefrom at high velocity. These (particles) are ejected in various directions generally normal to the surface of the sample toward the exit slit electrodes of the ionizing chamber. Some of these particles, upon reaching the vicinity of the exit slit, become ionized by a mechanism which is not entirely understood, but which is believed to be by charge transfer from the ionized gas. Since the energy of the ionized gas is controlled with narrow limits by the electron beam, the exited kinetic energy spread of the elemental ions is also quite limited.

By placing the sample in a removable probe (which holds the repeller electrode) various samples may readily be introduced into the ion chamber. Further, if the sample is placed in a recess in the end of the probe, the walls of the recess aid in directing the sputtering ions over the entire surface of the sample that is parallel to or opposite the exit slit. Since the elemental particles exit the sample surface primarily normal to the surface, there is a greater yield of elemental particles that are directed to the exit slit. This increases the yield of elemental ions. Preferably, the probe is formed of an electrically non-conducting material which further directs the ionizing gas to the surface areas desired and the elemental particles to the regions desired.

This method and apparatus have the advantage that the initial kinetic energy spread of the ions from the solid sample is quite low so that the mass analyzer does not have the be of the energy focusing type. This greatly reduces the complexity of the mass spectrometer. Furthermore, this analysis permits surface analysis of elemental solid samples, since the sample material is only removed from the surface. As the original surface is removed lower layers are exposed and in-depth profiles are generated. Further bulk analysis can be achieved by integrating spectral intensities over extended periods of time so that the data obtained represents a significant volume of the sample.

This method finds use in conventional mass spectrometers such as that depicted in the block diagram of FIG. 1. As may be seen with reference to this figure, the ion source 10 is of a conventional type having an output extractor or exit slit 12 (typically a plurality of extractor or cathode electrodes are employed to properly form the electric field) such that an ion beam 14 formed therein is caused to pass through the mass analyzer section 16 which may be magnetic, electric or a combination thereof, to selectively deflect and hence pass selected ions as a function of their mass to charge ratio. In the case shown in FIG. 1, these ions are deflected by the electrodes 18, which may be electrodes of a quadrupole type mass spectrometer, to a suitable transducer 20 which detects the presence and quantity of ions.

The mass analyzer section 16 is maintained at a relatively high vacuum as by the vacuum source 22. The ion source vacuum chamber likewise is maintained at a relatively low pressure by the vacuum source 24 albeit at a somewhat higher range, typically $10^{-3}$ torr, than the mass analyzer which is typically kept at $10^{-6}$ torr. The vacuum sources may be conventional, typically a diffusion pump or the like.

To operate effectively, as noted, the ion source 10 must be maintained at a higher or sputtering pressure, typically in the range of 0.1 torr and above, as compared to the normal ion source pressure of 0.001 torr. This may be accomplished by modifying a conventional ion source such as is described in U.S. Pat. No. 4,016,421, issued Apr. 5, 1977 to Hull et al. and in copending patent application Ser. No. 819,388, filed July 27, 1977 by Hull. As is described variously by Hull, the ion source illustrated in FIG. 2 consists of a housing 48 containing a cavity 49 and a plurality of electrodes. Among the electrodes are a sputtering or repeller electrode 50 which is used in accordance with this invention as a sputtering electrode. This repeller electrode 50 may be in the form of a removable probe 46, which is adapted to hold the solid sample as will be described hereinafter. An exit slit for the chamber, or extractor slit 51, which may comprise a pair of electrodes or plates 52 and 53 closely spaced with respect to one another, define the first extractor slit. The extractor slit 51 and the repeller electrode 50 are disposed opposite to one another and lie on the same axis perpendicular to the plane of the exit slit to define an ion forming region R therebetween.

The extractor electrode or slit 51 is maintained to have a relatively small cross-sectional area so as to permit the retention of the relatively high sputtering pressure required within the ionizing region R. This is accomplished by forming a layered structure comprising the plates 52 and 53 sandwiched with an insulator plate 80 such as mica or other suitable material and a field plate 82 formed of a suitable metal similar to that used in the ion source. The seal plate is a solitary plate having a relatively small opening 84 so as to limit the length of the extractor slit 51.

The ion source, as it is described in said Hull et al. patent, also includes second extractor electrodes 54,54' with a second extractor slit 55 formed thereby, a second focus slit 56 included therein. As was the case with extractor slit 51, the focus electrode comprises two plates 59 and 60 disposed relative to one another to define the focus slit 56.

These six electrodes are disposed in sequential order with the extractor slit 51 disposed in the cavity of the housing 48. In the embodiment illustrated, the electrodes are planar and parallel. It should be understood, however, that any other known configuration may be used. Furthermore, the ion beam source can be operated without the second extractor electrodes 54,54'. All of these electrodes as well as the housing are made from suitable metal such as a non-magnetic stainless steel or a metal such as sold under the trademark "Nichrome V". The electrodes in the ion beam source are supported on various support rods and insulators.

The ion beam source also includes gas inlet means in one side of the chamber 48 as depicted by the internally threaded inlet 150. This inlet 150 may, for example, connect directly to a skimmer nozzle or the like to receive a sample gas to be ionized and analyzed, but in this instance is the conduit for the introduction of ionizing gas. The inlet 150 includes the slanting passageway which communicates with the ionizing region R. In addition, means are provided for forming an electron beam in the ion forming region R. Any conventional means of forming this beam, as is well known to those skilled in the art of ion optics, may be used. An electron gun would be suitable. Preferably, this source is adjustable to vary the energy imparted to the ion chamber.

Figure 2:
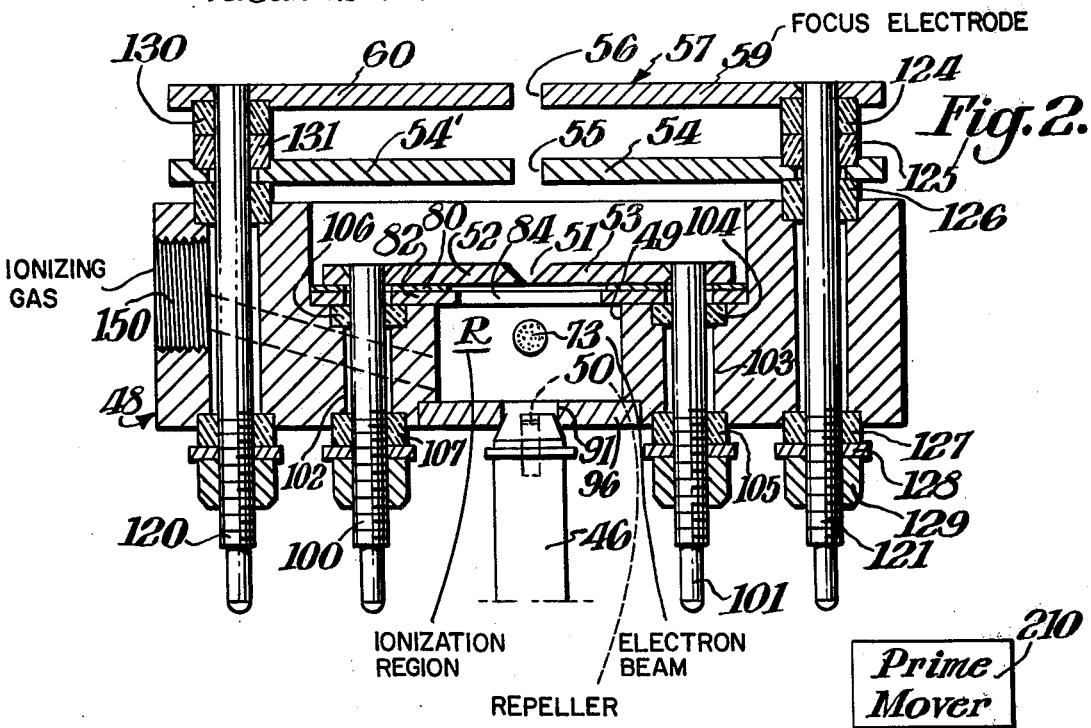
FIG. 2 illustrates an ion source.
Figure 3:
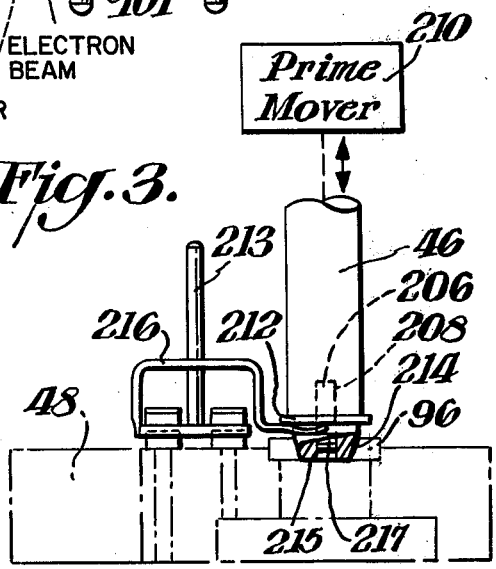
FIG. 3 illustrates a sample probe.

In FIG. 2 this source is depicted as an electron beam shown in cross-section 73. The beam is formed simply by an electrode (not shown) which is placed adjacent to the housing 48 at an electron beam aperture in the housing 48. This aperture may comprise nothing more than an orifice in the housing 48 covered by a suitable plate with an electron orifice formed therein as is described in said Hull et al. application. In this instance, the electron beam 73 may be formed by maintaining the electrode at a negative potential relative to the housing 48. The beam may be terminated in a trap (not shown). A potential of around 70 volts usually is sufficient to produce the desired electron beam energy. It is also desirable to provide a magnetic field in the ion forming region R parallel to the longitudinal axis of the electron beam to columnate the beam. Such field may be provided by a pair of permanent magnets (not shown). The various electrodes in the ion source are supported in a conventional manner using support rods and insulating beads.

The sandwiched extractor electrode, comprising the metal plates 52,53, the insulative plate 80 and the seal plate 82 is supported in a similar manner by rods 100 and 101, respectively. An electrical connection is made between each of these rods and the respective plates 52,53 by a welded joint. Enlarged openings in the seal plate 82 permit this plate to be insulated from the rods. The rod 100 passes through a channel 102 in the housing 48 and the rod 101 passes through a channel 103 in the housing. These rods are insulated from the housing by pairs of insulating washers 104, 105, 106, 107, respectively, which fit in annular recesses formed in the housing 48.

In a similar manner, the second extraction electrodes 54 and 54' and the focus plates 59 and 60 are mounted with respect to the housing 48 by rods 120, 121. The second extraction electrodes 54 and 54' do not make electrical contact with the rods. The focus plates 59 and 60 are supported by the rods 120 and 121 and their electrical connection is supplied through these rods by a welded joint. Spacing between the plates 59 and 60 and the electrodes 54,54', as well as the insulation of the rod 121 from the electrode 54, is accomplished by electrically insulating washers 124, 125, 126 and 127, respectively. A metal washer and nut 128 and a nut 129, which fit in the threaded end of rod 121, complete the structure.

In accordance with this invention, a plate 96 having a hole 91 bored therein is secured to the lower end of the cavity as by screws in a manner similar to that described in the said Hull application. This hole may be actually tapered 214 so as to be enlarged or flared outwardly. This hole 91 is adapted to receive a probe 46 such as that normally used to introduce a solid sample into an ionization source. The probe may be introduced into the chamber by a suitable crank or prime mover 210, as is conventional for sample probes. In this instance the probe, which may be formed of an insulating material of known type, has a hollowed end or bore 208 in which is adapted to be fitted a small rod 206 either of the solid sample to be analyzed or a rod coated with the solid sample to be analyzed. According to a preferred embodiment of this invention, the bore is made slightly greater in depth than the length of the rod. In this manner the exposed end of the rod is slightly recessed with only the end face 217, which is to be sputtered, exposed. The recess distance preferably is about 0.254 mm. In any event, the recess should not be deeper than 1.0 mm. The purpose of the recess is to force the sputtering ions to strike the entire end face of the sample rod and preferably to strike the end face normal to the plane of the face. This is accomplished because of the shielding afforded by the lip 215 of the probe. Under these conditions, the elemental particles that are sputtered tend to be expelled generally normal to the sample rod's end face 217 such that they are directed toward the exit slit 51 where their chance of becoming ionized, as described, by charge transfer, is enhanced. Only those particles which become ionized in the region of the exit slit have a chance of passing into the mass analyzer.

This invention affords a real advantage in that a conventional EI/CI ion source (as described) may also function to analyze solid samples simply by appropriately modifying the repeller voltage, introducing a suitable ionizing gas, and using the recessed sample probe. Typically, the sample is placed on the end face of the rod 206 in solution form and evaporated. The rod is then placed in the bore and the probe introduced in the cavity. If the rod itself is the solid sample, it is simply placed in the bore 208 and used as described.

An electrical connection may be made internally in the probe so that the rod may be biased to the required negative voltage, as was the repeller electrode 50, so it in turn may serve as a sputtering electrode. The external support for this probe is not shown since probe supports are well known in the art. Alternatively, an electrical connection may be made by crimping onto the end of the rod 206, as illustrated, (or a sleeve for the rod) a small metal washer 212 which is retained by a frustoconical shaped washer 214 which may be formed of a suitable electrically non-conducting material such as ceramic. The rod 206, and hence the washers 214 and 212, may be retained by a small tension spring engaging the inside of the bore 208. A wire clip 216, which may be mounted to the chamber 48 by screws with insulating washers, has an electrical connection 213. This clip 216 is U-shaped with the ends of the U being shaped and forming springy fingers which engage the washer 212 to provide the desired electrical connection to the sample rod 206.

Having described the structure of this solid sample probe and its advantages, its operation being substantially identical to the method already described, need not be further described. Suffice it to say that the solid sample ion chamber and probe (1) permit the use of single focussing mass spectrometers because of the lower initial energy spread, (2) are relatively insensitive to pressure in the chamber, (3) permit close control of the sputtering rate, and (4) provide a relatively higher yield than the planar diode sputtering systems, including the use of hollow cathodes, of the prior art.

We claim:

1. In a mass spectrometer having an ion source which includes a vacuum chamber, an inlet to said chamber for introducing a gas into said chamber, electrically energized electrode means including a repeller electrode and an exit slit for withdrawing ions from said chamber through said slit to form an ion beam, a mass analyzer section for deflecting ions in the ion beam according to their mass, and detector means for detecting those ions within the ion beam which have been deflected by a given angle by the mass analyzer section, electron beam means for ionizing said gas, the improvement for the elemental analysis of solids comprising:

means for introducing an ionizing gas into said chamber through said inlet;

means to evacuate said chamber to an ion sputtering pressure in the presence of said ionizing gas;

means to apply a potential to said repeller electrode that is negative with respect to said slit;

a probe that may be removably introduced into said chamber;

means for mounting said repeller electrode on said probe so that ions of said ionizing gas impinge on said repeller electrode for sputtering particles from its surface into the interior of said chamber whereby some of said sputtered particles, which are neutral in charge and in the vicinity of said slit become ionized by charge exchange with said ionizing gas and pass through said slit.

2. An ion source according to claim 1 wherein said probe is elongated and has a longitudinal axis, said repeller electrode being positioned coaxially within one end of said probe that is introduced into said chamber, thereby to direct sputtered material toward said exit slit.

3. An ion source according to claim 2 wherein said ionizing gas is inert.

4. An ion source according to claim 2 wherein said probe end is formed of an electrically non-conductive material and said repeller electrode is recessed within said probe.

5. An ion source according to claim 2 wherein said exit slit has an exit axis, said sample surface being positioned on said exit axis.

6. A method for the elemental analysis of solids using a mass spectrometer having a mass analyzer and an ion chamber having a repeller electrode and an exit slit for passing ions into said mass analyzer comprising the steps of:

introducing an ionizing gas into said chamber to provide a sputtering gas;

ionizing said ionizing gas in said chamber with an electron beam;

reducing the potential of said repeller electrode to a value less than that of said exit slit;

positioning a solid material sample whose surface is analyzed on said repeller electrode, whereby the surface is sputtered to provide neutral elemental particles; and directing said elemental particles toward said exit slit to become ionized by charge exchange with said ionizing gas and pass through said slit into said mass analyzer.

7. The method of claim 6 wherein said ionizing gas is directed toward the surface of said sample by an electrically non-conductive shield.

8. The method of claim 7 wherein said shield is coaxially positioned about said sample.

9. The method of claim 6 which includes positioning said sample surface parallel to the plane of said exit slit.

10. The method of claim 6 wherein said ionizing gas is inert.

* * * * *